US007153217B1

(12) United States Patent
Florian

(10) Patent No.: US 7,153,217 B1
(45) Date of Patent: Dec. 26, 2006

(54) GOLF SWING TRAINING APPARATUS

(76) Inventor: Raymond J. Florian, 14440 Elwell, Belleville, MI (US) 48111

( * ) Notice: Subject to any disclaimer, the term of this patent is extended or adjusted under 35 U.S.C. 154(b) by 0 days.

(21) Appl. No.: 10/956,400

(22) Filed: Oct. 4, 2004

(51) Int. Cl.
*A63B 69/36* (2006.01)

(52) U.S. Cl. ..... 473/267; 473/266; 473/409

(58) Field of Classification Search ..... 473/266, 473/267, 268, 269, 409
See application file for complete search history.

(56) References Cited

U.S. PATENT DOCUMENTS

| | | | | | |
|---|---|---|---|---|---|
| 1,399,761 | A | | 12/1921 | Garland | |
| 1,410,811 | A | * | 3/1922 | Lewis | 473/267 |
| 1,558,762 | A | * | 10/1925 | Richter | 473/267 |
| 1,567,530 | A | | 12/1925 | Macnaughton et al. | |
| 1,633,527 | A | | 6/1927 | Hansen | |
| 1,634,102 | A | | 6/1927 | Hansen | |
| 1,670,409 | A | | 5/1928 | Hansen | |
| 1,854,392 | A | | 5/1932 | Bambrick | |
| 1,960,787 | A | | 5/1934 | Macstocker | |
| 2,494,000 | A | * | 1/1950 | Robertson | 434/257 |
| 2,520,287 | A | | 8/1950 | Plunkett et al. | |
| 2,653,025 | A | | 9/1953 | Zega | |
| 3,339,927 | A | | 9/1967 | Nunn | |
| 3,353,282 | A | * | 11/1967 | Sneed | 434/257 |
| 3,489,416 | A | | 1/1970 | Mark | |
| 3,711,103 | A | | 1/1973 | Seltzer | |
| 3,794,329 | A | | 2/1974 | Wilson | |
| 3,795,399 | A | | 3/1974 | Beckish | |
| 3,915,457 | A | * | 10/1975 | Casey | 473/267 |
| 3,917,278 | A | * | 11/1975 | Steinman, Jr. | 473/267 |
| 4,071,251 | A | | 1/1978 | Beckish | |
| 4,383,687 | A | * | 5/1983 | Wolff | 473/267 |
| 4,415,159 | A | * | 11/1983 | Matheny et al. | 473/267 |
| 5,069,456 | A | | 12/1991 | Bellagamba | |
| 5,174,566 | A | * | 12/1992 | Kelnhofer | 473/267 |
| 5,249,967 | A | * | 10/1993 | O'Leary et al. | 434/247 |
| 5,427,370 | A | * | 6/1995 | Hamblin et al. | 473/238 |
| 5,439,225 | A | | 8/1995 | Gvoich et al. | |
| 5,467,993 | A | | 11/1995 | Higginson | |
| 5,486,003 | A | * | 1/1996 | Loew et al. | 473/267 |
| 5,603,617 | A | * | 2/1997 | Light | 434/252 |
| 5,895,327 | A | | 4/1999 | Francisco | |
| 5,904,484 | A | * | 5/1999 | Burns | 434/252 |
| 5,971,766 | A | * | 10/1999 | Guiney | 434/252 |
| 5,984,798 | A | | 11/1999 | Gilmour | |
| 6,165,079 | A | | 12/2000 | Czaja | |
| 6,273,826 | B1 | | 8/2001 | Bauer | |
| 6,364,786 | B1 | | 4/2002 | Khano | |
| 6,503,086 | B1 | * | 1/2003 | Golubov | 434/247 |
| 6,582,319 | B1 | | 6/2003 | Czaja | |
| 2002/0164567 | A1 | * | 11/2002 | Katayama | 434/252 |

* cited by examiner

*Primary Examiner*—Nini F. Legesse
(74) *Attorney, Agent, or Firm*—Charles W Chandler

(57) ABSTRACT

A golf swing training apparatus is intended for use in learning the proper technique of swinging a golf club to hit a golf ball and accelerate the golf ball along an intended path. The training apparatus includes a planar reflective panel, such as a mirror for visually identifying a users swing path. The training apparatus also includes a rigid panel for strengthening and supporting the reflective panel. The reflective panel includes markings that represent a person at the important golf club to golf ball impact stage so that a user may compare the user's positioning to that of the preferred positioning.

1 Claim, 5 Drawing Sheets

GOLF SWING TRAINING APPARATUS

BACKGROUND OF THE INVENTION

1. Field of the Invention

The invention relates to a golf swing training apparatus. In particular, this invention relates to a reflective surface with permanent markings thereon that represent an ideal position at a golf club to golf ball interface.

2. Description of the Prior Art

Golf is a very difficult sport to do well at, let alone master. Yet the popularity of the sport continues to grow. As the number of participants increase, so does the demand for training aides so that the experienced as well as, the neophyte may continue to improve their skills. Some of these teaching aides provide a reflective surface with either removable or repositionable lines. The removable or repositionable lines make the teaching aide difficult for repeated use and setup for a particular or even for multiple users. Yet other teaching aides provide for a convex reflective surface. The convex reflective surfaces distort the image of the user and are therefore difficult to achieve an accurate understanding of what the user is doing at any given position along the golf swing.

Furthermore, the fixed lines on prior disclosed devices, such as U.S. Pat. Nos. 5,486,003, 5,174,566, 3,917,278 and 5,603,617 do not include an explanation of what the lines represent during the swing. This makes it extremely difficult for a user to understand how to operate the training device and therefore requires training for the training device itself.

However, none of the above mentioned devices include a guideline representing the golf swing at impact of the golf ball. This is the most important element of the swing because this position ultimately determines the flight path of the golf ball.

Therefore, there is a need for a golf swing training apparatus that includes a planar reflective surface and has graphical representations of the preferred golf swing at impact as well as, alignment lines and instructions that are included so that the user may readily be able to set up and operate such a training device.

SUMMARY OF THE INVENTION

The golf swing training apparatus provides a vehicle for a user to observe the users golf swing and compare it to the proper positioning of the golf swing and, particularly, at the important impact of the golf club to golf ball position. This is done by providing a reflective surface with a marking of a representative person making the preferred golf club to golf ball impact imprinted thereon. The reflective surface is tinted to reduce background distractions and includes a key that represents all the important elements that, when all are accomplished together, results in the preferred golf club to golf ball impact and therefore, the preferred golf ball trajectory. The key includes symbols to represent the important elements that are reproduced at the marking of the representative person in the area that is affected by the important element, along with an arrow, to show the proper movement associated with the important element. The golf swing training apparatus may be angled so that any user may be aligned with the markings thereon. The golf swing training apparatus also includes removable placards for reminding the user of the important steps throughout the entire golf swing.

BRIEF DESCRIPTION OF THE DRAWINGS

Other advantages of the present invention will be readily appreciated as the same becomes better understood by reference to the following detailed description when considered in connection with the accompanying drawings wherein.

DETAILED DESCRIPTION OF THE PREFERRED EMBODIMENT

Figure 1:
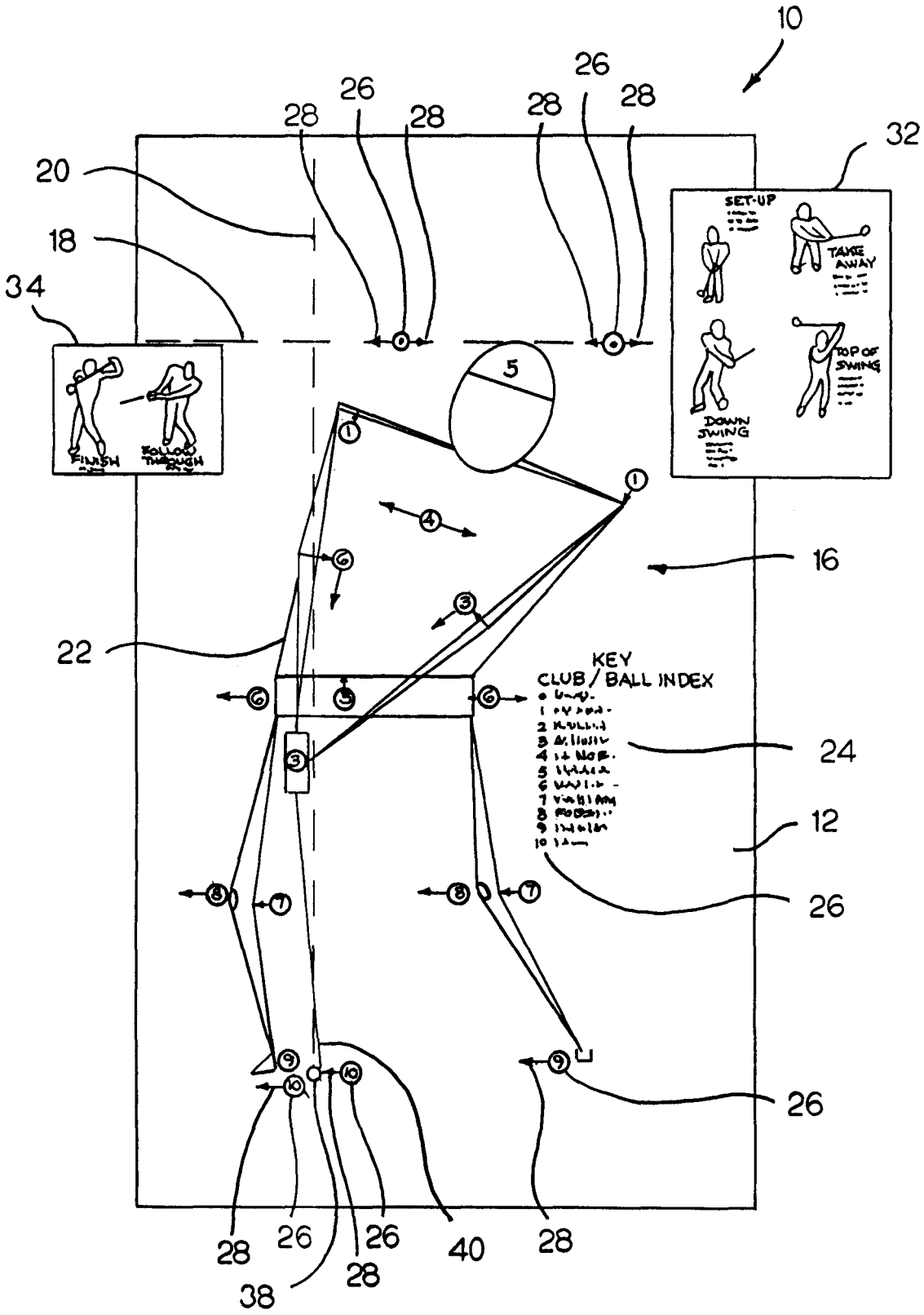
FIG. 1 is a front view of a golf swing training apparatus.
Figure 3:
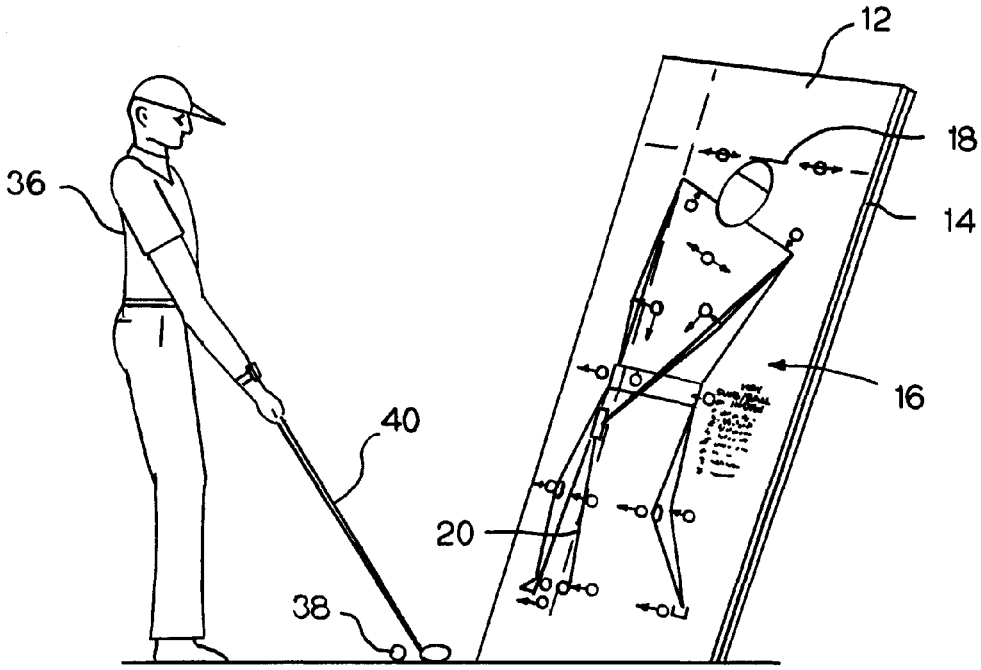
FIG. 3 is an isometric front view of the golf swing training apparatus while in use.

Referring to FIG. 1, a golf swing training apparatus is generally shown at 10. As best seen in FIG. 3, the training apparatus 10 includes a reflective panel 12 and a rigid panel 14. The rigid panel 14 is fixedly secured to the reflective panel 12 to strengthen and support the reflective panel 12.

Referring to FIG. 1, the reflective panel 12 is a generally planar reflective device, such as a mirror, but may be produced out of any highly reflective material that allows one to visually observe oneself and accepts a plurality of markings, generally indicated at 16. The markings 16 are produced by any known method, such as screen-printing, etching, painting, and the like. In the preferred embodiment, the reflective panel 12 is tinted so that reflected lights do not obscure the vision of a user and so other background objects become less distracting while using the training apparatus.

Referring to FIG. 3, the training apparatus 10 is generally rectangular and is of sufficient size that when placed in front of a hitting surface at an angle, the markings 16 align with a user 36. The markings 16 include a generally horizontal line 18 that aligns with the head of a user 36 and a generally vertical line 20 that aligns through a golf ball 38 placed on the hitting surface and continues through the shoulder of the user 36. The horizontal line 18 and the vertical line 20 provide the starting alignment for the user 36.

Referring to FIG. 1, the markings 16 also have an outline 22 of a person at the optimal positioning during a golf club 40 impact with the golf ball 38. The outline 22 is preferably in a color that is bolder than the other markings 16 so that the outline 22 is readily apparent to the user 36 at the most important step of the golf swing, the impact of the golf club 40 to the golf ball 38. The outline 22 comprises several important elements of the golf swing that the user 36 must concentrate on for improvement and are listed separately on a key 24. The key 24 includes a symbol 26, such as a number, letter, or the like, for the important element associated with it. The symbol 26 is reproduced on or near the outline 22 at the body location associated with the movement and includes directional arrows 28 for guiding the user through the movement.

Figure 2:
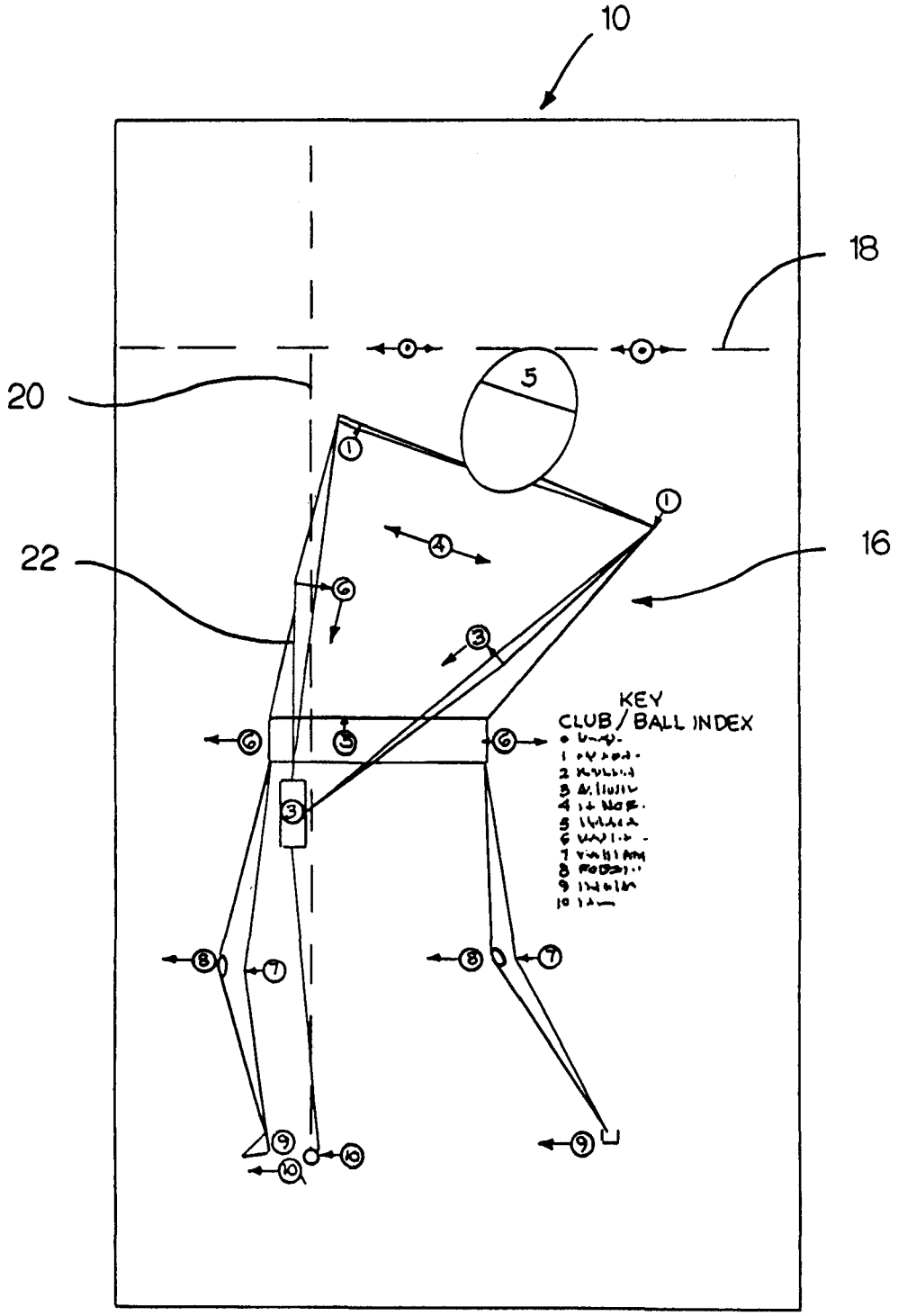
FIG. 2 is a front view of the golf swing training apparatus with placards attached.

Referring to FIG. 2, the training apparatus 10 further includes a first placard 32 and a second placard 34 positioned in such a way that both placards are easily viewable from the golf stance. Referring to FIGS. 1 and 2, the first and second placards 32, 34 are removably attached by any known method such as, hook and loop material, removable tape, attachment hooks, suction cups or similar methods.

The first placard 32 is positioned on the training apparatus 10 so that it is readily visible during a back swing, that is, when the golf club 40 is taken away from the golf ball 38, and through a down swing, that is, until the golf club 40 makes contact with the golf ball 38. The first placard 32 includes graphical and written information that the user 36 requires for the first part of the golf swing, that is, addressing the ball, the golf club take-away, the top of the swing, and down swing that leads to the outline 22 position. The second placard 34 is positioned on the training apparatus 10 so that it is readily visible after the impact of golf club 40 to the golf ball 38. The second placard 34 includes graphical and written information that the user 36 requires for learning the proper golf swing after the outline 22 position, such as, the follow through and finish steps.

In operation, referring to FIG. 3, the training apparatus 10 is positioned in front of the hitting surface at an angle so that the reflection of a user 36 is apparent to the user 36. The first placard 32 and the second placard 34 are attached to the training apparatus 10 such that the first and second placards 32, 34 are visible during the portion of the golf swing they are required. A golf ball 38 is placed on the hitting surface such that the vertical line 20 passes through the image of golf ball 38 and the shoulder of the user 36 and horizontal line 18 is aligned with the top of the image of the user's head. If the horizontal line 18 does not align with the head of the user 36, the golf ball and user are moved either towards or away from training apparatus 10 so that the alignment is achieved. Alternatively, the training apparatus 10 may be placed at a greater or lesser angle so that proper alignment is achieved. The training apparatus 10 may be adjusted to fit people of various sizes through the angle of the training apparatus 10. This positioning may be checked against the first placard 32 for reminders and instructions.

The first placard's 32 steps may be utilized to visually compare the reflection during the first part of the golf swing in each of the important steps leading to the outline 22 position. The outline 22 position may then be utilized to observe the reflection in the proper position at the golf club 40 to golf ball 38 impact. The second placard 34 may be utilized to verify the user 36 is in the proper position after the golf club 40 to golf ball 38 impact.

If the user 36 notices a difference anywhere along the swing, the user may review either the first placard 32, the outline 22 and key 24, or the second placard 34 for reminders on the specific area that needs to be addressed. The user 36 may place another golf ball 38 on the hitting surface and in alignment with the user's 36 shoulder and the vertical line 20. The user 36 may also align the top of the head of the user 36 with the horizontal line 18. The user 36 then repeats the steps above making any corrections that are required along the swing path until the proper technique is achieved.

Additionally, if the training apparatus 10 is desired to be utilized for the impact of the golf club 40 to the golf ball 38 only, the step of attaching the first placard 32 and the second placard 34 to the training apparatus 10 may be omitted.

Figure 4:
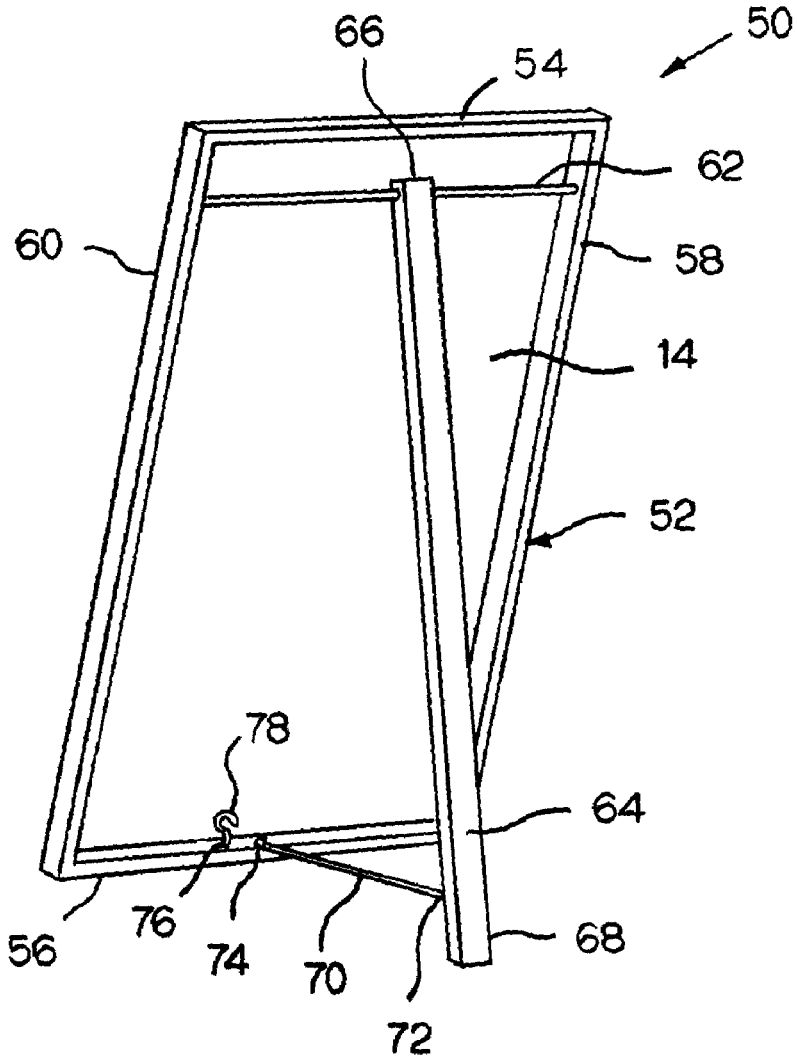
FIG. 4 is an isometric rear view of a second embodiment the golf swing training apparatus.
Figure 5:
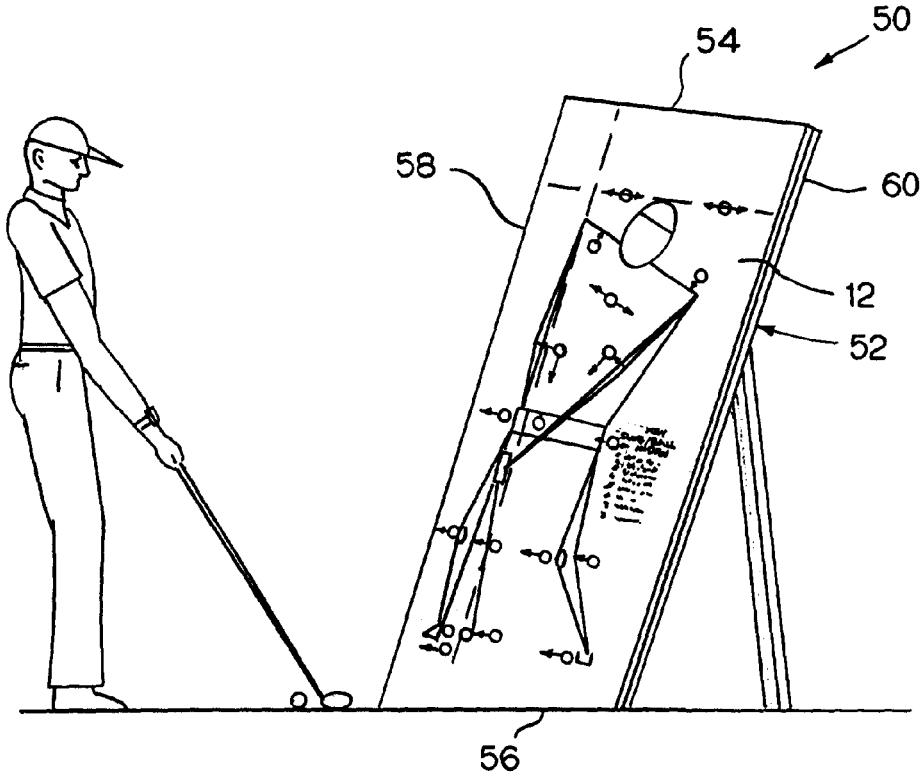
FIG. 5 is an isometric front view of the second embodiment of the golf swing training apparatus while in use.

Referring to FIGS. 4 and 5, a second embodiment of the training apparatus 50 is shown. Where the training apparatus 50 of the second embodiment is different from the first embodiment, new reference numbers will be used. The training apparatus 50 of the second embodiment utilizes a reflective panel 12 and a rigid panel 14 with markings 16, as the first embodiment. However, the reflective panel 12 and the rigid panel 14 are further strengthened by a frame 52. The frame 52 includes an upper section 54 and a lower section 56 interconnected and spaced apart by opposing side sections 58, 60.

Referring to FIG. 4, the side sections 58, 60 rotatably secure a support rod 62. The support rod 62 fixedly secures a support leg 64 at a first end 66 and extends to a distal second end 68. The support leg 64 includes a flexible limiting device 70, such as a string, rope, chain, or the like. The limiting device 70 extends between a leg end 72, and a frame end 74. The leg end 72 is fixedly secured adjacent to the second end 68. The frame end 74 is fixedly secured to the lower section 56. The limiting device 70 is for limiting the distance the support leg 64 may extend away from the training apparatus 50. The lower section 56 further includes at least one limiter post 76 adjacent the frame end 74 of the limiting device 70. The limiter post 76 is fixedly secured to the lower section 56 and has a generally C-shaped end 78 for accepting a portion of the limiting device 70. The limiting device 70 may be adjusted for length by wrapping the limiting device 70 around the limiter post 76, thereby adjusting the angle of the training apparatus 50.

The operation of the second embodiment is identical to the first embodiment after setup of the training apparatus 50 therefore, only the setup portion will be explained. The training apparatus 50 is positioned in front of the hitting surface. The second end 68 of the support leg 64 is extended away from the training apparatus 50 until the limiting device 70 is taught. The first placard 32 and the second placard 34 are attached to the training apparatus 50. A golf ball 38 is placed on the hitting surface such that the vertical line 20 passes through the golf ball 38 and the shoulder of the user and the horizontal line 18 aligns with the head of the user 36. If the horizontal line 18 does not align with the head of the user 36, the user 36 may move the golf ball 38 towards or away from the training apparatus 50 or angle the training apparatus 50 so that the alignment can be made.

The adjustment of the training apparatus 50 angle may be done by wrapping the limiting device 70 about the limiter post 76, thereby, reducing the distance the support leg 64 may be extended, thus requiring the training apparatus 50 to stand more erect. By adjusting the limiting device 70, the training apparatus 50 may be adjusted to fit multiple size users 36 easily. This positioning may be checked against the first placard 32 for reminders and instructions. The remaining swing steps are similar to those of the first embodiment and therefore, will not be repeated.

The invention has been described in an illustrative manner, and it is to be understood that the terminology, which has been used, is intended to be in the nature of words of description rather than of limitation.

Many modification and variations of the present invention are possible in light of the above teachings. It is, therefore, to be understood that within the scope of the appended claims, the invention may be practiced other than as specifically described.

Having described my invention, I claim:

1. A method for training a user to properly swing a golf club to propel a golf ball along an intended path, comprising the steps of:

providing a generally planar reflective panel having a plurality of markings fixed therein, including a horizontal line intersecting a vertical line and an outline of a person's body at an optimal position to strike a good golf shot when the golf club impacts the golf ball;

supporting the reflective panel in an upright position at a non-vertical angle;

positioning the user in front of the reflective panel at a horizontal distance there from to accommodate the user's height such that the image of the top of the user's head is proximate and below said horizontal line and the vertical line passes through the image of a golf ball positioned between the user and the reflective panel;

adjusting the angle of the reflective panel with respect to the user such that the image of the top of the user's head is proximate and below said horizontal line;

swinging a golf club toward the ball such that the top of the user's head remains proximate the horizontal line, and the vertical line remains aligned with the image of the golf ball; and comparing the user's reflected image to the outline.

* * * * *